US008161767B2

(12) United States Patent
Hwang

(10) Patent No.: US 8,161,767 B2
(45) Date of Patent: Apr. 24, 2012

(54) ICE MAKING APPARATUS OF REFRIGERATOR

(75) Inventor: Gue Sec Hwang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 705 days.

(21) Appl. No.: 11/969,153

(22) Filed: Jan. 3, 2008

(65) Prior Publication Data

US 2008/0163639 A1 Jul. 10, 2008

(30) Foreign Application Priority Data

Jan. 5, 2007 (KR) ..... 10-2007-0001579

(51) Int. Cl.
*A23G 9/00* (2006.01)
*F25C 5/18* (2006.01)
*F25C 1/00* (2006.01)

(52) U.S. Cl. ..... 62/345; 62/353; 62/344; 62/135

(58) Field of Classification Search ..... 62/353, 62/344, 135, 345
See application file for complete search history.

(56) References Cited

U.S. PATENT DOCUMENTS

| | | | | |
|---|---|---|---|---|
| 3,048,023 | A * | 8/1962 | Taylor | 62/135 |
| 6,938,428 | B2 * | 9/2005 | Onishi et al. | 62/135 |
| 2002/0014087 | A1 * | 2/2002 | Kwon | 62/340 |
| 2005/0241329 | A1 * | 11/2005 | Castrellon et al. | 62/340 |
| 2006/0112715 | A1 * | 6/2006 | Chung | 62/340 |

* cited by examiner

*Primary Examiner* — Frantz Jules
*Assistant Examiner* — Cassey D Bauer
(74) *Attorney, Agent, or Firm* — Birch, Stewart, Kolasch & Birch, LLP

(57) ABSTRACT

The ice making apparatus according to the preferred embodiment of the present invention is characterized in that a plurality of ice trays are arranged in the back-and-forth and up-and-down directions, and that the ice tray arranged in the front row and the ice tray arranged in the rear row are rotated to face each other.

17 Claims, 7 Drawing Sheets

ICE MAKING APPARATUS OF REFRIGERATOR

CROSS-REFERENCE TO RELATED APPLICATIONS

The present application claims priority under 35 U.S.C. 119 and 35 U.S.C. 365 to Korean Patent Application No. 10-2007-0001579 (filed on Jan. 5, 2007), which is hereby incorporated by reference in its entirety.

BACKGROUND

This document relates to an ice making apparatus of a refrigerator.

Generally, a refrigerator is a household appliance for refrigerating or freezing foods to freshly store them, wherein a freezing cycle is provided in the refrigerator, and it is a household appliance for freezing a storage space inside the refrigerator by directly/indirectly using cold air generated from the freezing cycle.

Recently, this kind of refrigerator is getting big and multi-functional in order to satisfy the improvement of diet and the taste of the user, and it is provided with various constituents for convenience of use.

Typically, a dispenser for dispensing the filtered water to the outside or an ice making apparatus for automatically making ice cubes is further provided in the refrigerator, the dispenser and the ice making apparatus are continuously reformed to improve the convenience of use.

Also, a structure of a tray provided in the ice making apparatus to make ice cubes and a structure for ice-separating are provided. Particularly, the ice-separating structure includes a structure that ice cubes are separated from the tray by rotating a separate ejector when the tray is fixed, and a structure that ice cubes are separated from the tray by a distortion movement of the tray itself.

SUMMARY

An object of the present invention is to provide an ice making apparatus of a refrigerator that can take out the greater amount of ice cubes in a restricted space and allow the separated ice cubes to be safely dropped into a storage container.

To achieve these objects and other advantages and in accordance with the purpose of the invention, as embodied and broadly described herein, there is provided an ice making apparatus of a refrigerator, including a plurality of ice trays receiving drinking water for ice-making and arranged in the back-and-forth direction; a drive device provided at one side of the ice tray to rotate the ice trays; and a container in which ice cubes separated from the ice trays are stored, wherein the ice tray disposed at a front row and the ice tray disposed at a rear row are rotated in order to face each other during an ice-separating operation.

According to another aspect of the present invention, there is provided an ice making apparatus of a refrigerator, including a plurality of ice trays arranged in the back-and-forth direction; a drive gear transferring a rotational force to the plurality of ice trays; a plurality of driven gears coupled to one sides of the plurality of ice trays respectively and receiving the rotational force from the drive gear; and a container provided below the ice tray to store the separated ice cubes, wherein some of the driven gears are directly connected to the drive gear and the rest are indirectly connected to the drive gear via a switching gear.

According to further another aspect of the present invention, there is provided an ice making apparatus of a refrigerator, including a plurality of ice trays arranged in the front and rear rows and the upper and lower layers, respectively; a drive device connected to one side of the ice trays to rotate the ice trays automatically or manually; a distortion-inducing means provided at the other side of the ice trays to induce the distortion of the ice trays; and a guide member disposed in a discrete space between the adjacent ice trays in the back-and-forth direction in order to prevent the ice cubes separated from the upper ice trays from colliding with the lower ice trays.

According to the above described configuration, a plurality of ice trays are arranged in the ice making apparatus in a multi-stage manner, so that a large amount of ice cubes can be dispensed.

Also, the plurality of ice trays are rotated to face each other and the ice cubes are dispensed, so that the ice making apparatus can be more compactly designed because there is no need to secure a space for the drop of the ice cubes.

Also, since the plurality of ice trays are rotated to face each other, the ice cubes are dropped into the center of the storage container and the ice cubes are prevented from scattering out of the storage container.

DETAILED DESCRIPTION OF THE EMBODIMENTS

Figure 1:
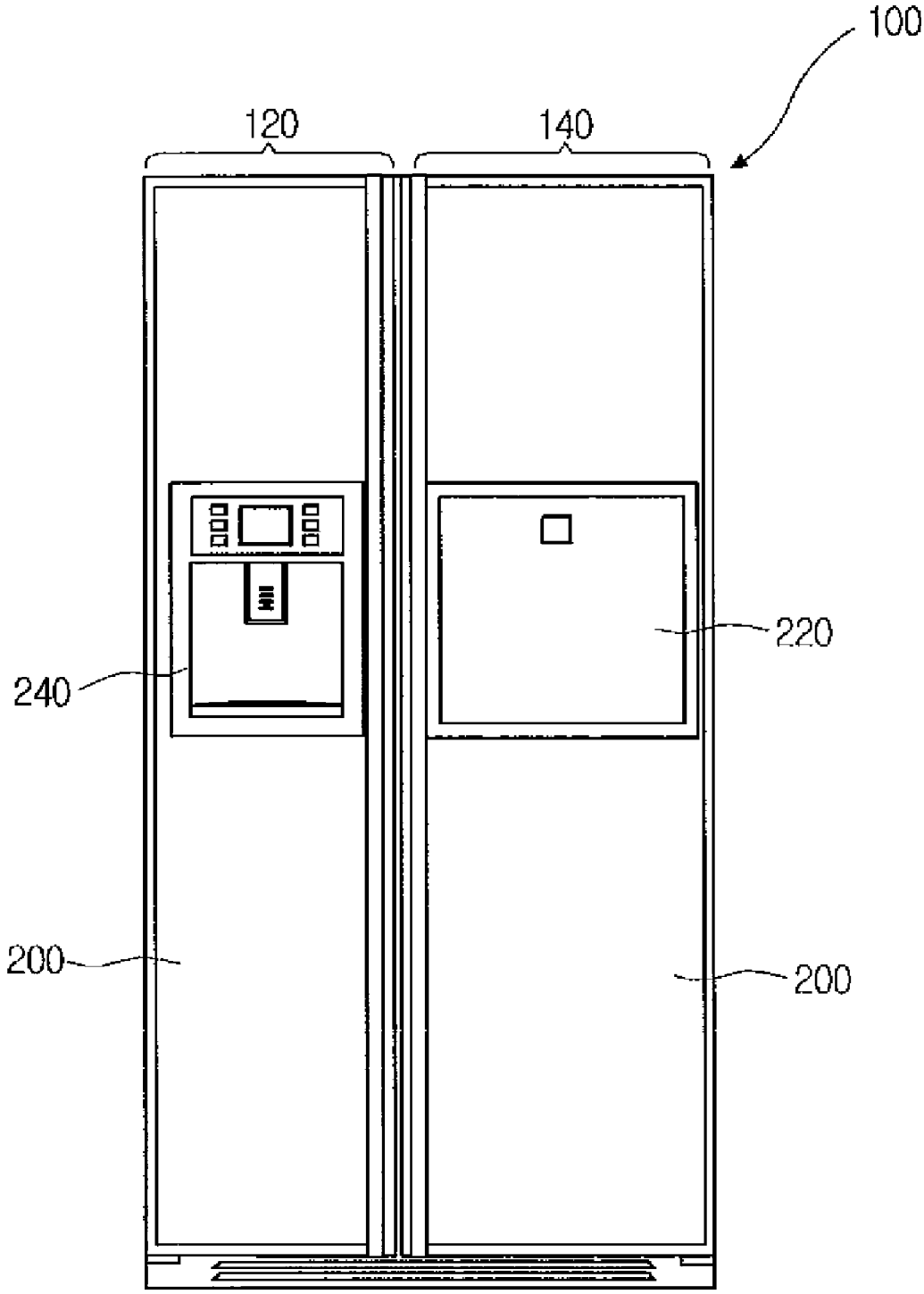
FIG. 1 is a front view of a refrigerator having an ice making apparatus according to a preferred embodiment of the present invention.
Figure 2:
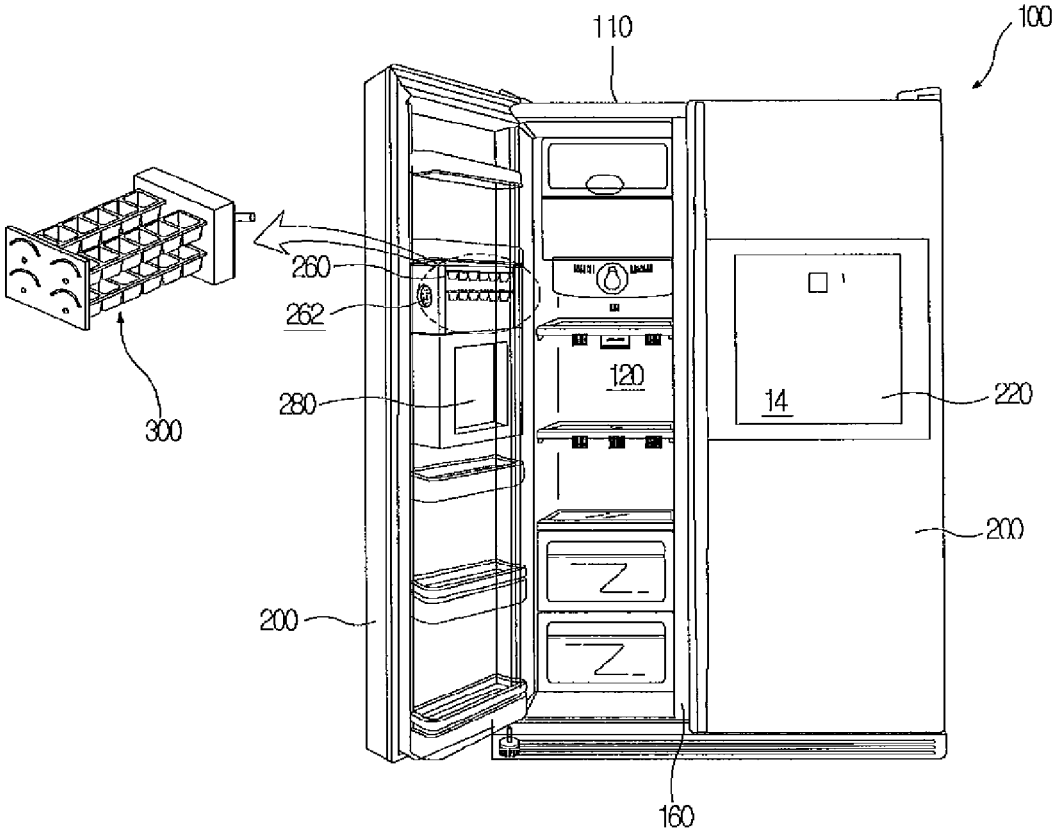
FIG. 2 is a perspective view showing an inner construction of the refrigerator.

FIG. 1 shows a front view of a refrigerator having an ice making apparatus according to a preferred embodiment of the present invention, and FIG. 2 shows a perspective view of an inner construction of the refrigerator.

Referring to FIGS. 1 and 2, a refrigerator 100 according to the embodiment of the present invention includes a body 110 in which a freezing chamber 120 and a refrigerating chamber 140 are provided; a door 200 opening/closing the freezing chamber 120 and the refrigerating chamber 140; a home bar 220 provided at a front surface of the door 200 to take out the foods without opening the door 200; and a dispenser 240 for dispensing the filtered water or ice cubes to the outside. And, a plurality of shelves, drawers and baskets for receiving the foods are provided in the freezing chamber 120 and the refrigerating chamber 140.

Further, according to the embodiment of the present invention, the door 200 for opening/closing the freezing chamber 120 and the refrigerating chamber 140 is respectively provided, since the freezing chamber 120 and the refrigerating chamber 140 are provided at either side of the refrigerator, respectively. And, the home bar 220 and the dispenser 240 may be provided at a freezing door 200 and a refrigerating door 200, respectively, or they are may be provided at one door. And, it is possible to take out the ice cubes from the outside without opening the door 200, as the dispenser 240 is connected with an ice making apparatus 300. That is, a discharge duct for discharging the ice cubes may be provided in the door having the dispenser 240.

Meanwhile, an ice making apparatus 300 is provided at the back side of the door 200 to take out the ice cubes from the outside. The ice making apparatus is capable of ice-making and ice-separating by using water supplied from the outside.

Particularly, the ice making apparatus 300 is accommodated in a case 260 provided at the back side of the door 200. And, a container 280 for storing the ice cubes is provided right below the case 260.

Also, a cold air hole 262 is formed at one side of the case 260. The cold air hole 262 is to provide cold air for ice-making into the ice making apparatus 300, it is perforated and formed in one side of the case 260. And, a cold air passage, through which the cold air supplied from an evaporator (not shown) is passed, may be formed in a barrier 160 partitioning the refrigerating chamber 140 and the freezing chamber 120. And, the cold air hole 262 is communicated with the cold air passage when the door 200 is closed, and therefore the cold air supplied from the evaporator may be directly supplied into the ice making apparatus 300. And, the container 280 may be configured that it can be moved in/out after opening the door 200.

Meanwhile, the ice making apparatus 300 will be described in detail with reference to the accompanying drawings.

Figure 3:
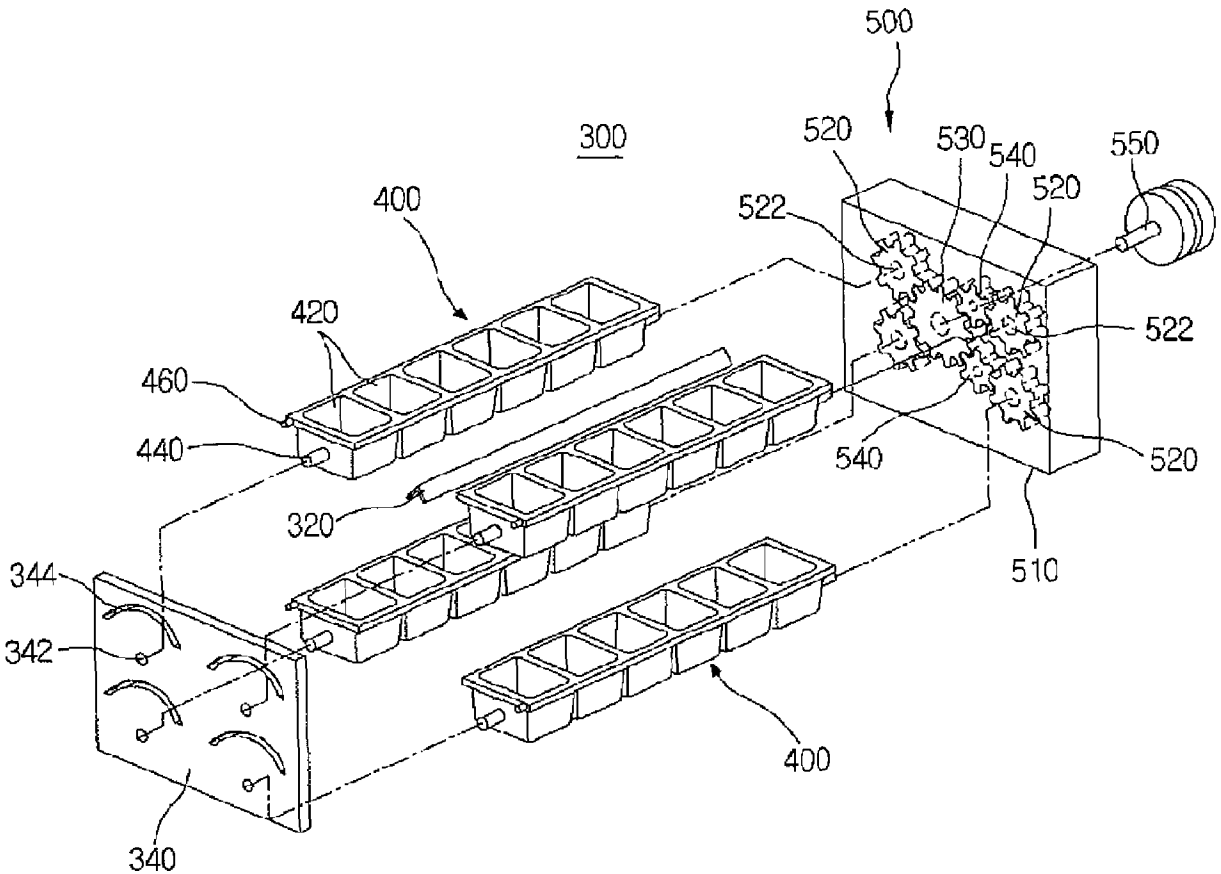
FIG. 3 is an exploded perspective view of an ice making apparatus according to a preferred embodiment of the present invention.
Figure 4:
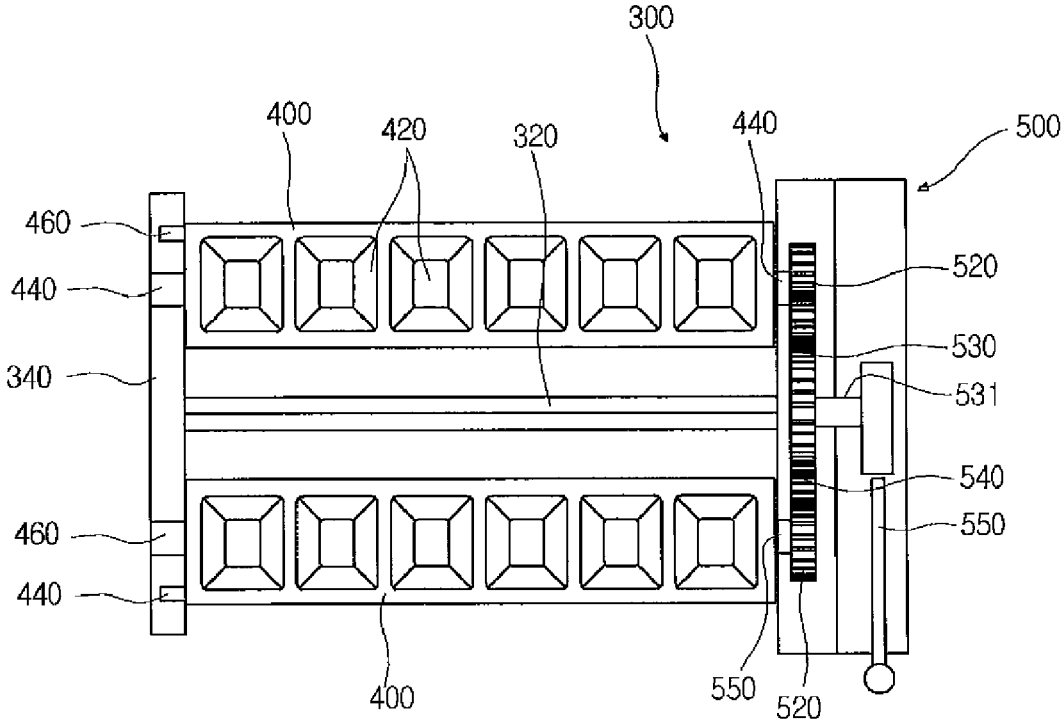
FIG. 4 is a plan view of the ice making apparatus.

FIG. 3 shows an exploded perspective view of an ice making apparatus according to a preferred embodiment of the present invention, and FIG. 4 shows a plan view of the ice making apparatus.

Referring to FIGS. 3 and 4, the ice making apparatus 300 includes a plurality of ice trays 400 in which water for ice-making is received, a drive device 500 provided at one side of the ice trays 400 to rotate the ice trays 400, and a limiting member 340 provided at the other side of the ice trays 400 to support the ice trays 400. For the sake of convenience, the side where the limiting member 340 is provided is defined as a left side, and the side where the drive device 500 is provided is defined as a right side.

Particularly, the inner space of the ice tray 400 is divided by a plurality of cells 420. And, the cells 420 are depressed at a predetermined depth in order to receive water for making ice. And, the cells 420 may be formed in a tapered shape in which the cross-section is decreased toward the lower part in order to easily dispense the ice cubes.

Also, a plurality of ice trays 400 may be provided in the back-and-forth and up-and-down directions. According to the proposed embodiment, a plurality of ice trays 400 are arranged in the front and rear rows and the upper and lower layers.

Also, a rotation axis 440 is protruded from left and right sides of the ice tray 400. And, the rotation axis 440 allows the ice tray 400 to be rotatably installed in the drive device 500 and the limiting member 340. Particularly, the rotation axis 440 formed at the left side of the ice tray 400 is inserted into an insertion port 342 formed in the limiting member. And, the rotation axis 440 formed at the right side of the ice tray 400 is inserted into a connection port 522 of the driven gear 520 (to be explained).

Also, an protrusion 460, which is outwardly protruded, is further formed at a top edge of the left side of the ice tray 400. The protrusion 460 is inserted into a limiting hole 344 of the limiting member 340 to restrict a rotational movement of the ice tray 400.

Here, when all of the ice trays 400 are rotated in one direction, all of the protrusions 460 may be formed at any one of the front half portion and the rear half portion of the top edge of the left side of the ice tray 400. However, when the ice tray 400 provided in the front row and the ice tray 400 provided in the rear row are rotated to face each other, the positions of the protrusions 460 are different to each other. In other words, according to the ice tray 400 provided in the rear row, the protrusion 460 is formed at the rear half portion of the top edge of the left side of the ice tray 400. On the other hand, according to the ice tray 400 provided in the front row, the protrusion 460 is formed at the front half portion of the top edge of the left side of the ice tray 400.

Meanwhile, the drive device 500 serves to rotate the ice tray 400, it separates the ice cubes from the ice tray 400 by forcibly rotating the ice tray 400 when the ice making operation is completed.

The drive device 500 includes a housing 510 defining an external appearance, a rotation means 550 provided at the inner side of the housing 510 to generate rotational force, a drive gear 530 connected to a rotation axis of the rotation means 550, a driven gear 520 connected to the drive gear 530 in order to transfer rotational force, and a switching gear 540 provided between the drive gear 530 and the driven gear 520 in order to switch the rotational direction of the driven gear 520 to the rotational direction of the drive gear 530.

Particularly, the driven gear 520 is rotated with the ice tray 400, as it is connected with the rotation axis 440 of the respective ice tray 400. Therefore, the driven gears 520 are provided in the same number as the number of the ice trays 400. And, a connection port 522 for inserting the rotation axis 440 of the ice tray 400 is formed in the center of the driven gear 520.

Also, the drive gear 530 serves to transfer rotational force to the plurality of the driven gears 520, it may be disposed at the approximate center of the inner side of the housing 510. And, some of the driven gears 520 are directly connected to the drive gear 530, and the rest are indirectly connected to the drive gear 530 via the switching gear 540.

For example, as shown in the drawings, the driven gear 520 connected with the ice tray 400 provided in the rear row is directly connected to the drive gear 530, and the driven gear 520 connected with the ice tray 400 provided in the front row is indirectly connected to the drive gear 530 via the switching gear 540. Therefore, the driven gear 520 provided at the rear side is rotated counter to the direction of the driven gear 520 provided at the front side. This is to rotate all of the plurality of ice trays 400 in the central direction of the ice making apparatus 300 by rotating the driven gears 520 in the opposite directions to each other.

More particularly, as the ice trays 400 provided in the front row and the ice trays 400 provided in the rear row are rotated to face each other, the ice cubes are prevented from scattering out of the container 280 while separating the ice cubes by dropping the separated ice cubes into the center.

Also, a guide member 320 is provided in a space corresponding to the inside of the rectangular shape connecting the rotation axis 440 of the plurality of ice trays 400.

Particularly, the guide member 320 is an element that prevents the ice cubes dropped from the upper ice trays 400 from colliding with the lower ice trays 400. Therefore, the guide member 320 may be laterally disposed to have the length corresponding to that of the ice tray 400. That is, it may be extended from the housing 510 of the drive device 500 to the limiting member 340. And, the guide member 320 may be formed in the shape of an approximately triangle or "Λ," of which both surfaces are downwardly slanted, and therefore the ice cubes are efficiently guided to the container 280.

Meanwhile, the rotation means 550 serves to provide power for rotating the ice trays 400, and a drive motor may be applied as shown in FIG. 3 and an operation lever may be applied as shown in FIG. 4.

Particularly, when the drive motor is applied, the rotation axis of the drive motor is connected to the drive gear 530. And, when the operation lever is applied, the operation lever is bent in the shape of "¬," and the bent portion is connected to the rotation axis 531 of the drive gear 530. Otherwise, an element in the shape of a dial 560 may be applied as a rotation means 550, this will be described with reference to the drawings.

Meanwhile, the limiting member 340 allows one side of the plurality of ice trays 400 to be rotatably supported. And, the limiting member 340 may be provided as a separate element as shown in the drawings, or some of the rear surface of the door may also serve as the limiting member 340. In the latter case, the rotation axis 440 of the ice tray 400 is directly inserted into the rear surface of the door 200.

Particularly, an insertion port 342 in which the rotation axis of the ice tray 400 is inserted and a limiting hole 344 in which the protrusion 460 of the ice tray 400 is inserted are formed in the limiting member 340.

More particularly, the limiting hole 344 receives the protrusion 460, and it guides the movement of the protrusion 460 when the ice tray 400 is rotated. And, the limiting hole 344 is formed in the shape of a circular arc so that it serves to define the rotational limit of the ice tray 400.

The limiting hole 344 allows the ice tray 400 to be rotated within a predetermined angle (about 90-120°), so that the ice cubes in the ice tray 400 are separated from the ice tray 400. Particularly, an element establishing the rotational limit is not provided at the side of the ice tray 400 where the drive device 500 is contacted. Therefore, in a state that the ice tray 400 is rotated to an end of the limiting hole 344, the right side of the ice tray 400 is further rotated by rotational force of the driven gear 520, and therefore the ice tray 400 is distorted. And, the ice cubes formed in the cells 420 are separated by the distortion of the ice tray 400.

Here, the limiting member 340, the protrusion 460 and the rotation axis 440 serve to induce the distortion of the ice tray 400 as well as to support the ice tray 400, and thus, they are referred to as a distortion-inducing means.

Hereinafter, an operation of the ice making apparatus of the refrigerator according to the present invention will be described with reference to the drawings.

Figure 5:
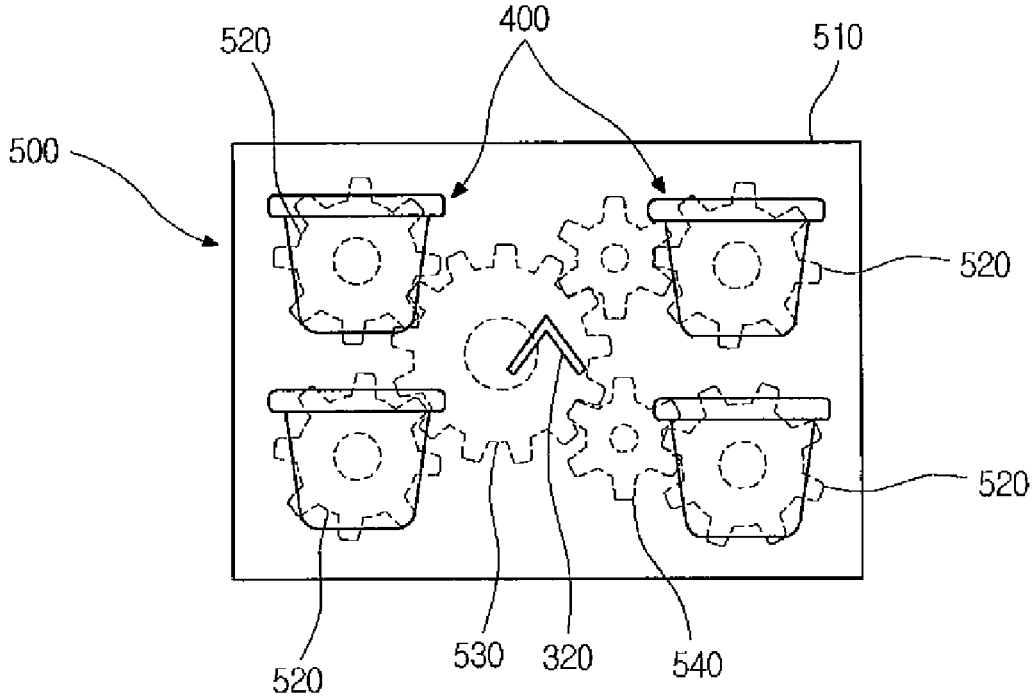
FIG. 5 is a side view showing a state before an ice-separating operation of an ice making apparatus according to a preferred embodiment of the present invention.
Figure 6:
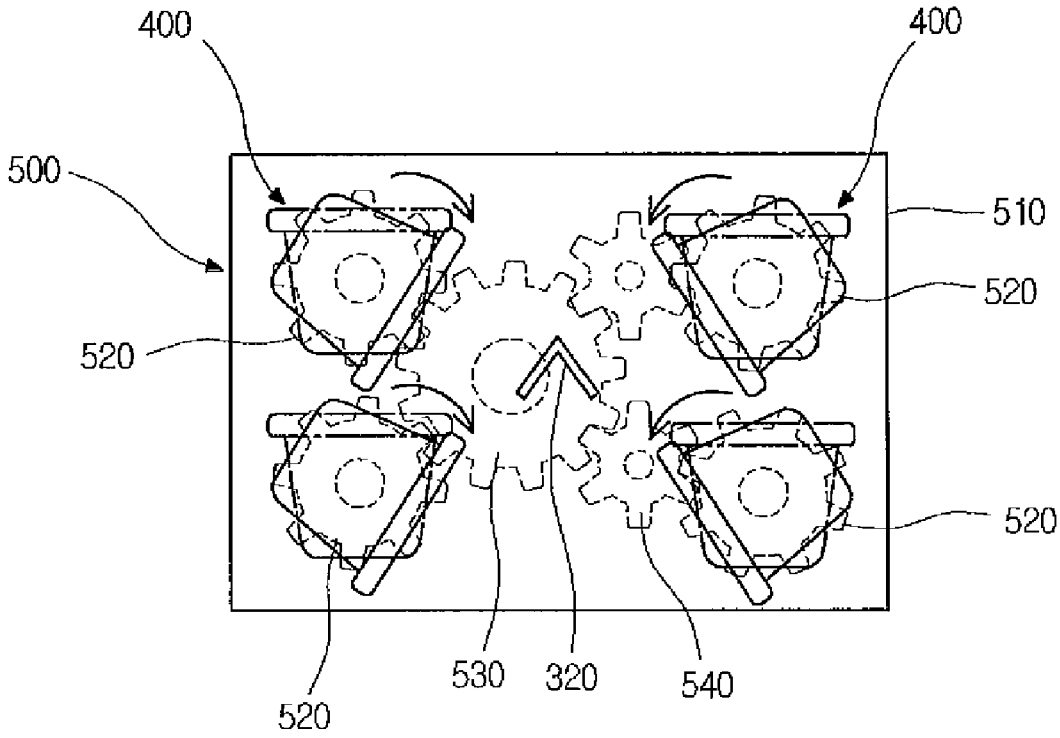
FIG. 6 is a side view showing the ice-separating operation of the ice making apparatus.

FIG. 5 shows a side view of a state before an ice-separating operation of an ice making apparatus according to a preferred embodiment of the present invention, and FIG. 6 shows a side view of the ice-separating operation of the ice making apparatus.

Referring to FIGS. 5 and 6, for the operation of the ice making apparatus 300, tap water supplied from the outside of the refrigerator body 110 is initially supplied into a water-filter via a valve in the body 110, and then the filtered water is supplied into the ice making apparatus 300 through a valve.

Further, the respective cell 420 formed in the ice tray 400 is filled with the water supplied into the ice making apparatus 300, and the water supply is stopped when the plurality of cells 420 are fully filled with water.

In this state, cold air for ice-making is supplied into the ice making apparatus 300 through the cold air hole 262, and water received in the ice tray 400 is frozen by the cold air supplied into the ice making apparatus 300.

After the water supplied into the ice tray 400 is completely frozen and the ice making is finished, the ice-separating operation that the ice cubes are dispensed from the ice trays 400 is carried out. Here, for the ice-separating operation, it is necessary to rotate the ice tray 400, and the drive device 500 is operated for this purpose.

Here, the ice tray 400 is rotated by the electric motor when the ice making apparatus 300 is fully automated, and the ice tray 400 is rotated by operating the operation lever when the ice making apparatus 300 is semi-automated or non-automated at all.

Meanwhile, if the rotation means 550 is operated, the drive gear 530 is rotated, and therefore the driven gear 520 and the switching gear 540, which are connected with the drive gear 530, are rotated by the rotation of the drive gear 530. And, the ice tray 400 arranged in the front row of the upper and lower layers and the ice tray 400 arranged in the rear row of the upper and lower layers are rotated in the opposite directions to each other.

Also, if the ice tray 400 is rotated by the operation of the rotation means 550, the protrusion 460 of the ice tray 400 moves along the limiting hole 344 of the limiting member 340. And, if the ice tray 400 is rotated at a predetermined angle (about 90-120°), the protrusion 460 is caught by the limiting hole 344. And, the right side end of the ice tray 400 is further rotated where the protrusion 460 is caught by the limiting hole 344, and therefore the ice tray 400 is distorted. And, the ice cubes are separated by the distortion of the ice tray 400. And, the separated ice cubes are dropped and stored in the container 280. And, when the ice-separating operation is completed, the drive device 500 is reversely operated and the ice tray 400 is returned to its original position.

Meanwhile, the ice cubes separated from the ice tray 400 is freely dropped into the container 280 without any interference by the guide of the guide member 320.

Here, the ice cubes stored in the container 280 may be automatically dispensed to the outside through the dispenser 240, or they may also be dispensed to the outside by taking out the container 280 itself.

Various embodiments other than the above described embodiment of the ice making apparatus 300 of the refrigerator according to the present invention are possible, hereinafter they will be described in detail with reference to the drawings.

Figure 7:
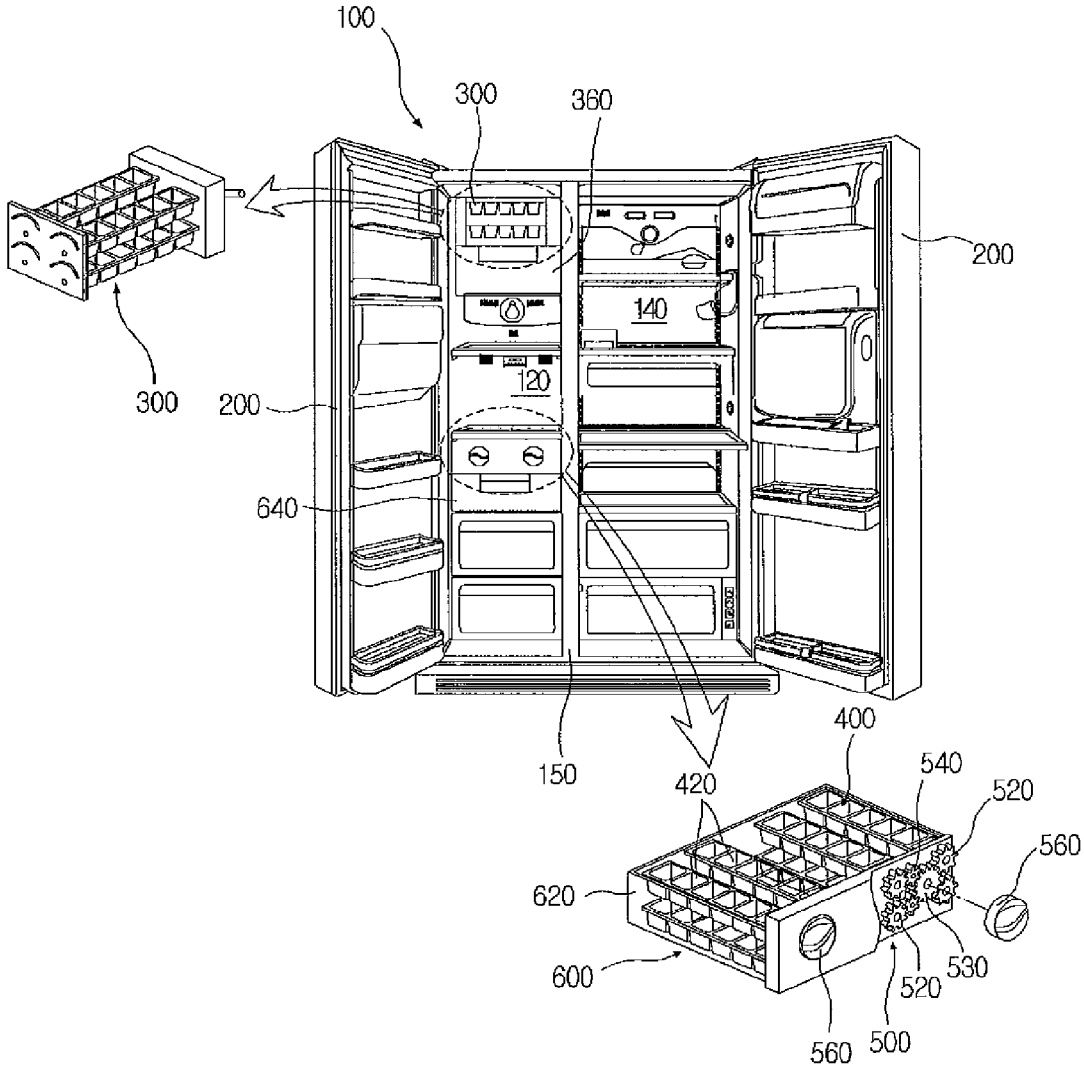
FIG. 7 is a perspective view showing an inner construction of a refrigerator having an ice making apparatus according to another preferred embodiment of the present invention.

FIG. 7 shows a perspective view of an inner construction of a refrigerator having an ice making apparatus according to another preferred embodiment of the present invention.

The ice making apparatus 300 of the refrigerator according to another preferred embodiment of the present invention is similar to that of the above-described embodiment, and therefore the same part is referred to as the same reference numeral and the detailed description thereof will be omitted.

Referring to FIG. 7, the ice making apparatus 300 of the refrigerator according to another preferred embodiment may be provided in the inner side of the refrigerator body 110 as well as the refrigerator door 200.

When water for ice-making is automatically supplied as the ice making apparatus 300 is fully automated or semi-automated, the ice making apparatus 300 is installed in the body 110 in the same manner as the above-mentioned configuration, and a container 360, in which ice cubes are dispensed from the ice tray 400 and stored, is provided at the lower part of the ice making apparatus 300 in the shape of a drawer.

Further, the ice making apparatus may be provided at the inner side of the refrigerator body 110 as it is not-automated at all.

This kind of manual ice making apparatus 600 is installed at one side of the freezing chamber of the body 110, and the ice making apparatus is detachably drawn and inserted in a drawer manner. And, the water supplied into the ice tray 400 is directly supplied by the user without a separate supply means.

According to the construction of the ice making apparatus 600, the ice making apparatus 600 includes a frame 620 installed at one side of the body 110 and having a rectangular frame shape, an ice tray 400 provided at the inner side of the frame 620 to receive water for ice-making, and a drive device 500 for driving the ice tray 400.

An upper surface of the frame 620 is opened to easily supply water for ice-making. And, the ice tray 400 which is formed in the back-and-forth direction is rotatably installed at the inner side of the frame 620.

A plurality of cells 420 are formed in the ice tray 400 in a row, and a plurality of ice trays 400 are parallel-installed as they are spaced apart in the back-and-forth direction and the up-and-down direction.

Further, a drive device 500 for rotating the ice tray 400 is provided at the front surface of the frame 620. The drive device 500 is the same as that of the above-mentioned embodiment, and therefore the description thereof will be omitted. However, there is a difference that a dial knob 560 is provided as a rotational means for supplying rotational force. And, the drive device 500 is provided at the front surface of the frame 620, and the dial knob 560 is connected to the drive gear 530. And, the dial knob 560 is formed to be exposed to the outside at the front surface of the frame 620. And, the rear surface of the frame 620 may serve as the limiting member 340. In other words, an insertion port (not shown) and a limiting hole (not shown), where the rotation axis 440 of the tray 400 and the protrusion 460 are inserted, are formed in the rear surface of the frame 620. Further, if the ice making apparatus 600 is pushed from the front to the rear of the frame 620, the rotation axis 440 and the protrusion 460 are accurately inserted into the insertion port and the limiting hole.

Also, a container 640, in which the ice cubes generated from the ice making apparatus 600 are dispensed and stored, may be provided below one side of the body 110, where the ice making apparatus 600 is mounted, in a drawer manner.

It should be understood that the scope of the present invention is not limited to these examples, and it will be apparent to those skilled in the art that various modifications and variations can be made in the present invention without departing from the scope of the present invention.

What is claimed is:

1. An ice making apparatus of a refrigerator, comprising:

a plurality of ice trays, each ice tray having an open top configured to receive drinking water for ice-making, the ice trays including a first ice tray and a second ice tray laterally spaced from the first ice tray;

a drive gear transferring a rotational force to the plurality of ice trays;

a plurality of driven gears coupled to one side of the plurality of ice trays, respectively, and receiving the rotational force from the drive gear;

a switching gear having gear teeth and provided between the drive gear and the plurality of driven gears, the switching gear adapted to switch rotation of the driven gears such that one of the driven gears is rotated counter to the direction of another one of the driven gears; and a container in which ice cubes separated from the ice trays are stored, wherein the open tops of the first ice tray and the second ice tray are rotated to face each other during an ice-separating operation.

2. The ice making apparatus of the refrigerator according to claim 1, wherein a plurality of cells are arranged in a row in an inner space of each of the plurality of ice trays.

3. The ice making apparatus of the refrigerator according to claim 1, further comprising rotation means for generating rotational force, the rotation means including at least one of a drive motor, a lever and a dial knob.

4. The ice making apparatus of the refrigerator according to claim 1, further comprising:

a limiting member provided at the other side of at least one of the plurality of ice trays to support the at least one tray and define the rotational limit of the ice tray.

5. The ice making apparatus of the refrigerator according to claim 1, further comprising:

a case surrounding the plurality of ice trays and provided with a cold air hole formed at one side of the case.

6. The ice making apparatus of the refrigerator according to claim 1, wherein the ice making apparatus is installed at a back side of the refrigerator door or in a freezing chamber.

7. The ice making apparatus of the refrigerator according to claim 1, wherein the ice making apparatus is detachably provided in the freezing chamber in the shape of a drawer.

8. The ice making apparatus of the refrigerator according to claim 1, wherein the tray, to which the driven gear directly connected with the drive gear is connected, and the tray, to which the driven gear connected with the switching gear is connected, are arranged in the back-and-forth direction.

9. An ice making apparatus of a refrigerator, comprising:

a plurality of ice trays receiving drinking water for ice-making, the ice trays including a first set of ice trays and a second set of ice trays laterally spaced apart from each other, the first set of ice trays and the second set of ice trays each including an upper ice tray and a lower ice tray;

a drive motor connected to one side of the ice trays to rotate the ice trays automatically or manually;

a distortion assembly provided at the other side of the ice trays to induce the distortion of the ice trays;

a container provided below the ice trays to store separated ice cubes; and a guide member disposed between the first set of ice trays and the second set of ice trays in order to prevent the ice cubes separated from the upper ice trays from colliding with the lower ice trays and to guide the ice cubes into a center of the container, wherein the guide member includes a first inclination part configured to be inclined to the bottom of the container and a second inclination part configured to cross the first inclination part.

10. The ice making apparatus of the refrigerator according to claim 9, wherein the guide member is extended in a longitudinal direction of the ice trays.

11. The ice making apparatus of the refrigerator according to claim 9, wherein the guide member is disposed between an upper ice tray and a lower ice tray.

12. The ice making apparatus of the refrigerator according to claim 9, wherein the cross-section of the guide member is formed in the shape of a triangle or "Λ."

13. The ice making apparatus of the refrigerator according to claim 9, wherein the distortion assembly includes a rotation axis protruded at the center of a side surface of at least one of the plurality of ice trays, a protrusion protruded from a side edge portion of each ice tray, and a limiting member in which the rotation axis and the protrusion are accommodated.

14. The ice making apparatus of the refrigerator according to claim 13, wherein the limiting member is formed with an insertion port for inserting the rotation axis and a limiting hole defining the rotational limit of each ice tray as the protrusion is inserted and moved.

15. The ice making apparatus of the refrigerator according to claim 14, wherein the limiting hole is in the shape of a circular arc having a predetermined length.

16. The ice making apparatus of the refrigerator according to claim 14, wherein the protrusion of an ice tray in the first set of ice trays and the protrusion of an ice tray in the second set of ice trays are symmetrically formed at locations with respect to the guide member.

17. The ice making apparatus of the refrigerator according to claim 13, further comprising:

a case which encompasses the plurality of ice trays, wherein the limiting member is separately provided or is a portion of a side surface of the case.

* * * * *